US007987828B2

(12) United States Patent
Zhu

(10) Patent No.: US 7,987,828 B2
(45) Date of Patent: Aug. 2, 2011

(54) MECHANICALLY VARIABLE CAM TIMING DEVICE

(75) Inventor: Lu Zhu, Troy, MI (US)

(73) Assignee: Schaeffler KG, Herzogenaurach (DE)

( * ) Notice: Subject to any disclaimer, the term of this patent is extended or adjusted under 35 U.S.C. 154(b) by 379 days.

(21) Appl. No.: 12/360,983

(22) Filed: Jan. 28, 2009

(65) Prior Publication Data

US 2009/0188455 A1 Jul. 30, 2009

Related U.S. Application Data

(60) Provisional application No. 61/024,309, filed on Jan. 29, 2008.

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 5,012,774 A * 5/1991 Strauber et al. ..... 123/90.17

* cited by examiner

*Primary Examiner* — Zelalem Eshete
(74) *Attorney, Agent, or Firm* — Lucas & Mercanti, LLP

(57) ABSTRACT

The mechanical variable cam timing device has a camshaft connector, a sprocket, a sprocket ring and a connector ring, all of which have teeth with slanted side walls that mate to form a circumferential ring. The sprocket ring and the connector ring move axially so as to shift the spacing between the teeth and provide for a phase shift.

11 Claims, 7 Drawing Sheets

MECHANICALLY VARIABLE CAM TIMING DEVICE

FIELD OF THE INVENTION

This Invention relates to valve timing control devices and, more particularly, to a mechanical device for adjusting an angular position of an internal combustion engine camshaft in relation to the engine crankshaft.

BACKGROUND OF THE INVENTION

Typically, variable cam timing (VCT) devices are hydraulic in nature and use pressurized engine oil to change the phase between the camshaft and the crankshaft using a phaser having a rotor and a stator where the stator has pressure chambers and the rotor has vanes in the pressure chambers. Oil is pumped into the chambers to rotate the rotor vanes and cause a shift in phase.

Such hydraulic devices require an accurate control of the oil leakages. Such a requirement can be difficult and the difficulty is enhanced due to the engine conditions and operating temperatures.

Devices for mechanically controlling the phase shift are known, see, for example, U.S. Pat. Nos. 5,012,774 and 5,638,782.

OBJECT OF THE INVENTION

The object of this Invention is to provide a simple mechanical means for shifting the relative angular position of the crankshaft and the camshaft, not only for vehicular engines but also in other operations.

These and other objects of the present Invention will be more readily understood by reference to the following description.

SUMMARY OF THE INVENTION

The objects of the present Invention are achieved by using a camshaft connector and a crankshaft sprocket in combination with a sprocket sliding ring and a connector sliding ring, each of which have teeth that have slanted sidewalls that abut one another and form a circumferentially ring. The rings are moved axially and independently from one another so as to cause an adjustment of the angular position of the camshaft in relation to the crankshaft.

Broadly, the present Invention is directed to a device for adjusting an angular position of an internal combustion engine camshaft in relation to the engine crankshaft comprising:

a camshaft connector fixed at an input end of a camshaft, the camshaft connector having a cylindrical, axial connector housing and a plurality of connector teeth extending axially and helically from one end of the connector housing;

a crankshaft sprocket rotatably mounted at the input end of the camshaft and engageable with an engine crankshaft, the crankshaft sprocket having a cylindrical, axial sprocket housing and a plurality of sprocket teeth extending radially outward from one end of the sprocket housing, each of the sprocket teeth having axial, slanted sidewalls that are parallel to each other and equal and opposite a corresponding sidewall of the connector teeth, the one end of the connector housing facing the one end of the sprocket housing and the connector teeth extending over the one end of the sprocket housing;

a sprocket sliding ring axially and rotatably mounted on the sprocket housing, the sprocket ring having a ring housing, a fin extending radially outward from the ring housing, a plurality of sprocket ring teeth extending trapezoidally and axially from the ring housing, and a shoulder extending radially outward from a distal end of the sprocket ring teeth, the sprocket ring teeth extending over the one end of the sprocket housing such that non-parallel axial, sidewalls of the sprocket ring teeth mate with a corresponding sidewall of the connector teeth and the sprocket teeth;

a connector sliding ring axially and rotatably mounted on the connector housing, the connector ring having a ring housing, a fin extending radially outward from the ring housing, a plurality of connector ring teeth extending trapezoidally and axially from the ring housing, and a shoulder extending radially outward from a distal end of the connector ring teeth, the connector ring teeth extending over the one end of the sprocket housing such that non-parallel axial sidewalls of the connector ring teeth mate with a corresponding sidewall of the connecting teeth and the sprocket teeth;

a spring washer is axially movable mounted over both the sprocket ring teeth and the connector ring teeth, between the connector ring shoulder and the sprocket ring shoulder and between the connector ring shoulder and a proximal end of the connector ring teeth and the sprocket ring shoulder and a proximal end of the sprocket ring teeth; and a fin moving means for axially moving the sprocket ring fin and the connector ring fin to adjust the angular position of the camshaft in relation to the crankshaft.

The base of the trapezoid teeth is the proximate end of the teeth. Preferably, the connecting ring teeth and the sprocket ring teeth are isosceles trapezoids.

Preferably, the number of teeth on the camshaft connector, the crankshaft sprocket, the sprocket ring and the connector ring are the same and, more preferably, the number is three.

The fin moving means is suitably a solenoid or a hydraulic means.

Preferably, a hydraulic means is used which comprises a valve body housing having two internal radially oriented oil channels which are axially spaced from one another. One of the oil channels engages a distal end of the sprocket ring fin and the other oil channel engages a distal end of the connector ring fin. In other words, the fins extend into their respective oil channels. Preferably, the fins extend into the oil channel so as to divide the oil channel into two compartments. Each oil channel has two inlets which allows oil to be pumped to one side or the other side of the fin thereby moving the fin in an axial direction with respect to the camshaft. This movement of the fin is then translated into a movement of the teeth for the respective ring which, in turn, allows for the phase shift of the camshaft with respect to the crankshaft. In order to maintain a seal between the fin, each fin is suitably equipped with an axial sealing ring that is affixed to the distal end of the fin and seals the oil channel with respect to the inner wall of the valve body.

BRIEF DESCRIPTION OF THE DRAWINGS

These and other aspects of the present Invention may be more readily understood by reference to one or more of the following drawings which are presented herein for illustration purposes only.

DETAILED DESCRIPTION OF THE DRAWINGS

Mechanical variable cam timing device 10 is mounted on an internal combustion engine camshaft and connected to a crankshaft by a chain or belt in a conventional manner. Specifically, camshaft connector 20 is fixed to an input end of a camshaft in a conventional manner and crankshaft sprocket 22 is rotatably mounted on the camshaft at its input end and has a chain or belt which connects to the crankshaft of the engine in a conventional manner.

Figure 1:
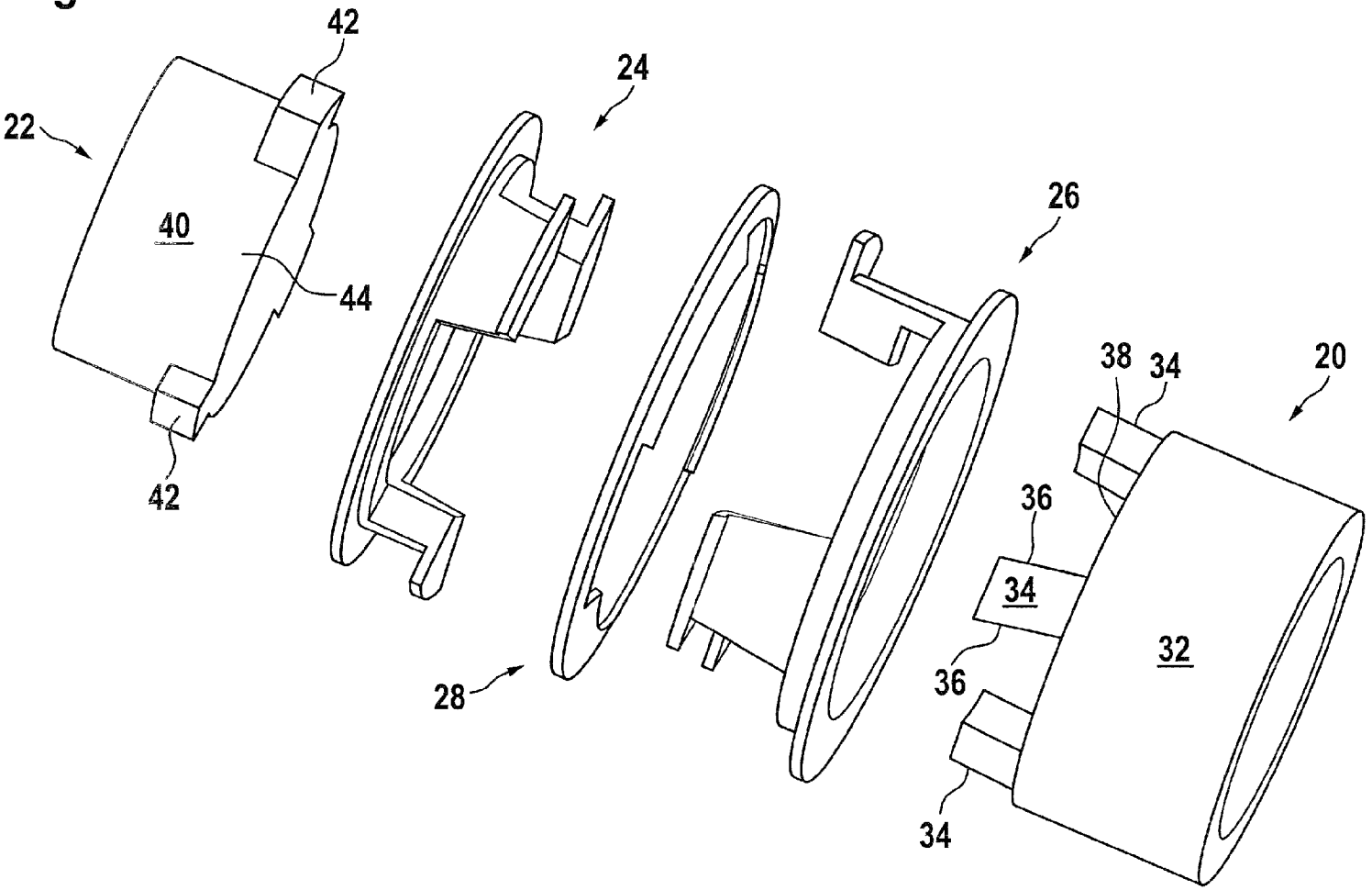
FIG. 1 illustrates an exploded view of the device of the present Invention.
Figure 2:
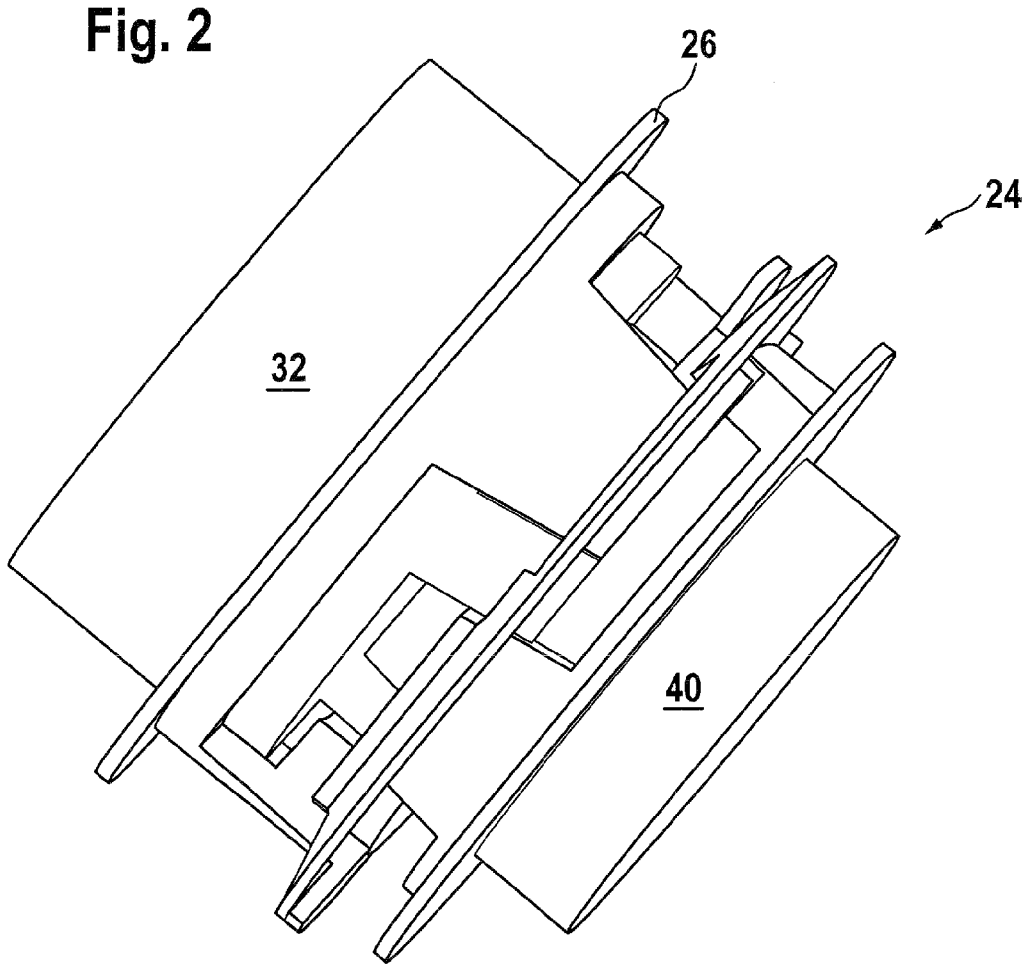
FIG. 2 illustrates an assembled view of the device of the present Invention.
Figure 3:
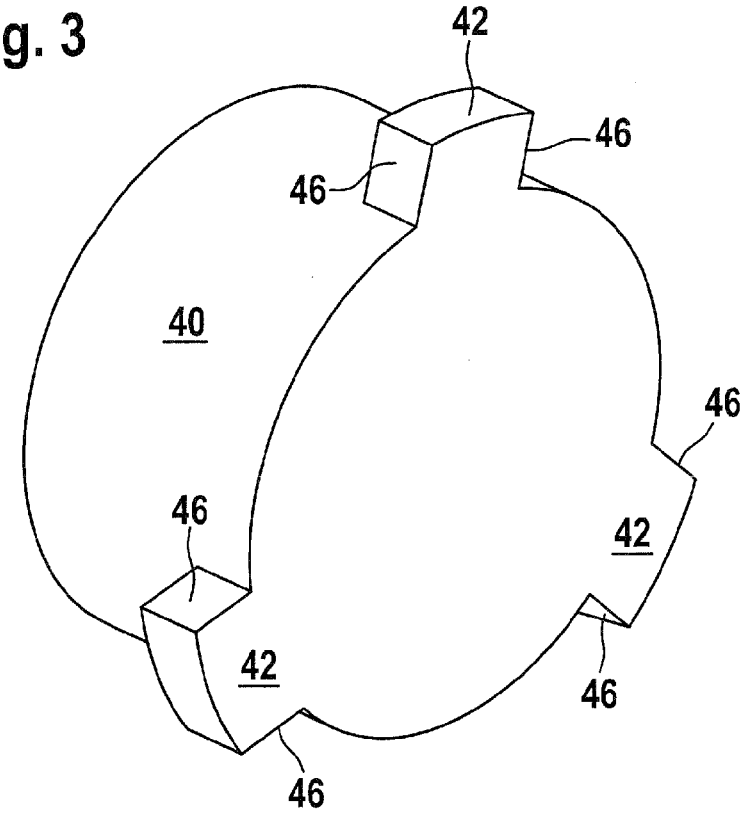
FIG. 3 illustrates the sprocket of the present Invention.
Figure 4:
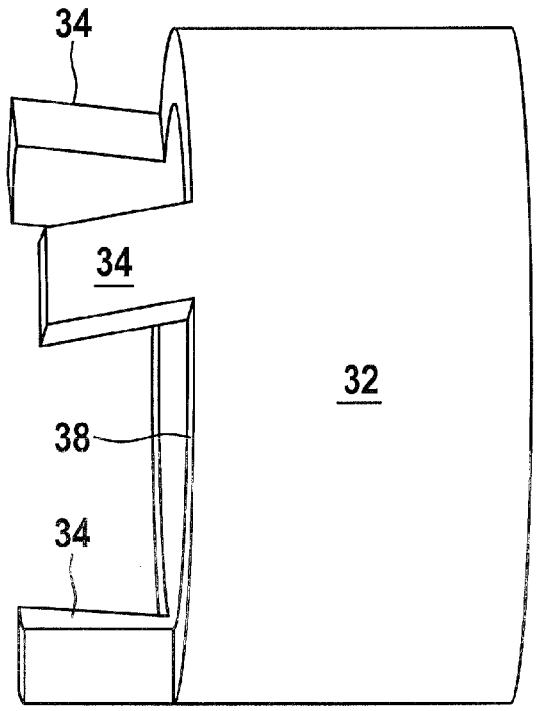
FIG. 4 illustrates the camshaft connector of the present Invention.

FIG. 1 illustrates an expanded view of device 10 while FIG. 2 illustrates an assembled view of device 10.

Device 10 has camshaft connector 20, crankshaft sprocket 22, sprocket sliding ring 24, connector sliding ring 26, washer 28 and valve body housing 30 as a fin moving means. For valve body housing 30, see FIG. 8.

Camshaft connector 20 has connector housing 32 and connector teeth 34. As illustrated, there are three connector teeth 34 which have axial sidewalls 36 and extend from one end 38 of connector housing 32. Connector teeth 34 are helical teeth which have a parallelogram shape when viewed radially from the side. Connector teeth 34 can also be referred to as skewed teeth.

Sprocket 22 has sprocket housing 40 and sprocket teeth 42. As illustrated, there are three sprocket teeth 42 and sprocket teeth 42 extend radially outward from one end 44 of sprocket 40. Sprocket teeth 44, when viewed above from a radial direction, have sidewalls 46 that are slanted. Thus, teeth 42 have the image of a parallelogram. As can be seen in FIG. 2 in the assembled position, connector teeth 34 extend over one end 44 of sprocket housing 40.

Figure 5:
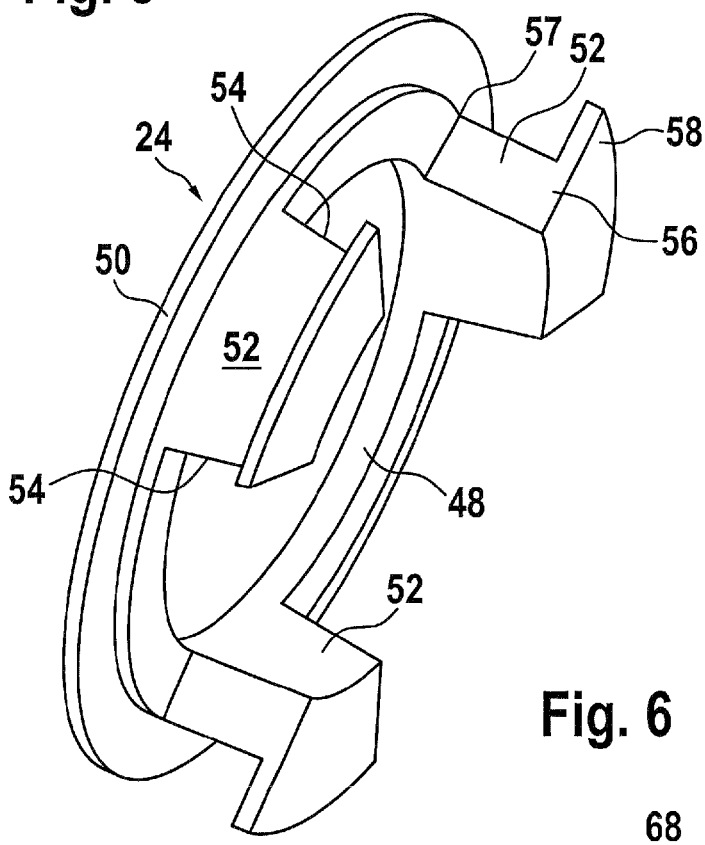
FIG. 5 illustrates the sprocket ring of the present Invention.

Sprocket ring 24 has sprocket ring housing 48 which is mounted around and slidable on the outside of sprocket 22. Extending radially outward from sprocket ring housing 48 is fin 50. Extending axially out from sprocket ring housing 48 are sprocket teeth 52. As can be seen clearly in FIG. 5, there are three sprocket ring teeth 52. Sprocket ring teeth 52 are trapezoidal in shape and have sidewalls 54 that are slanted axially. Sprocket ring teeth 52, when viewed face on in a radial direction have an appearance of a trapezoid where the base of the trapezoid is attached to sprocket ring housing 48. Preferably, this trapezoidal shape of sprocket ring teeth 52 is that of an isosceles trapezoid. Distal end 56 of sprocket ring teeth 52 has shoulder 58 extending radially outward therefrom. Proximal end 57 of sprocket ring teeth 52 is the point of attachment between sprocket ring housing 48 and sprocket ring teeth 52.

Figure 6:
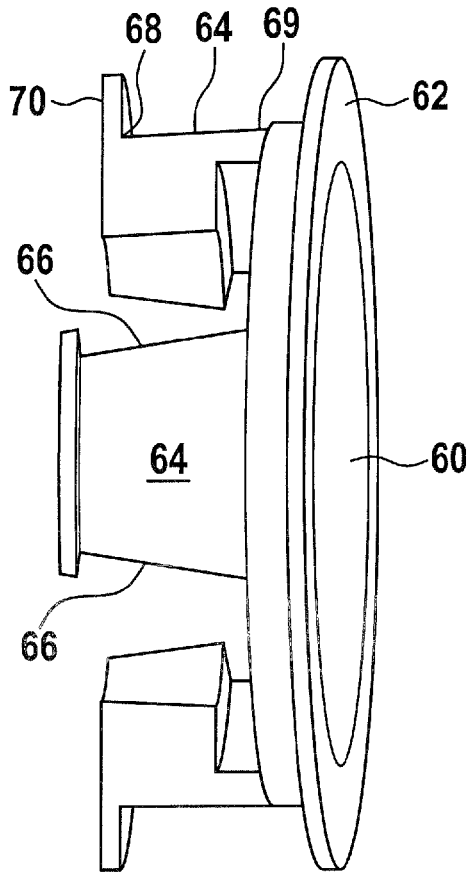
FIG. 6 illustrates the connector ring of the present Invention.
Figure 7:
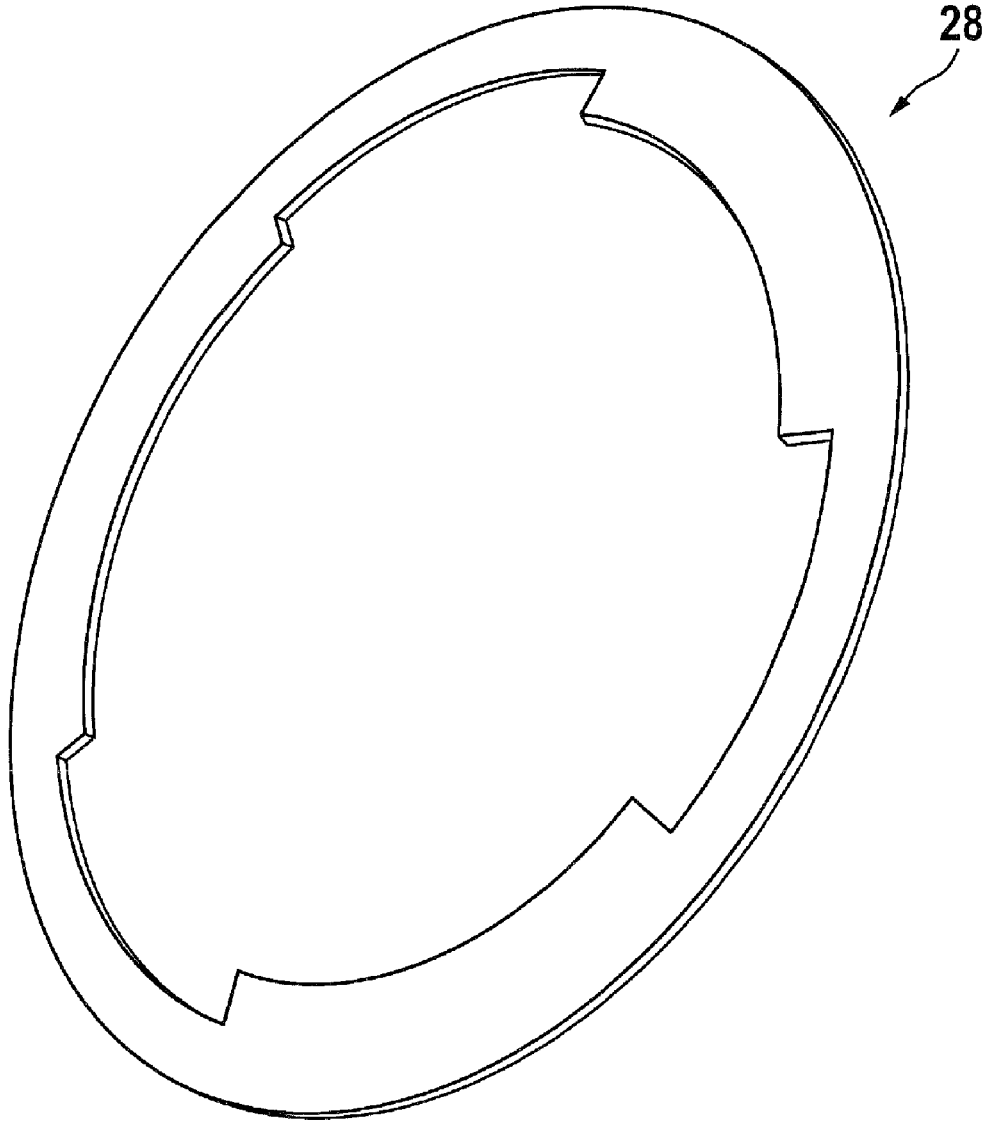
FIG. 7 illustrates the washer of the present Invention.

Connector sliding ring 26, which is illustrated in more detail in FIG. 6, has connector ring housing 60 from which fin 62 extends radially outward. Connector ring teeth 64 extend axially outward from connector ring housing 60. Connector ring teeth 64, take the shape of a trapezoid and, preferably, an isosceles trapezoid. This means that sidewalls 66 of connector teeth 64 have equal and opposite angles. Extending from distal end 68 of connector teeth 64 is shoulder 70 which extends radially outward from distal end 68. Proximal end 69 of connector ring teeth 64 is fixed to connector ring housing 60.

Figure 8:
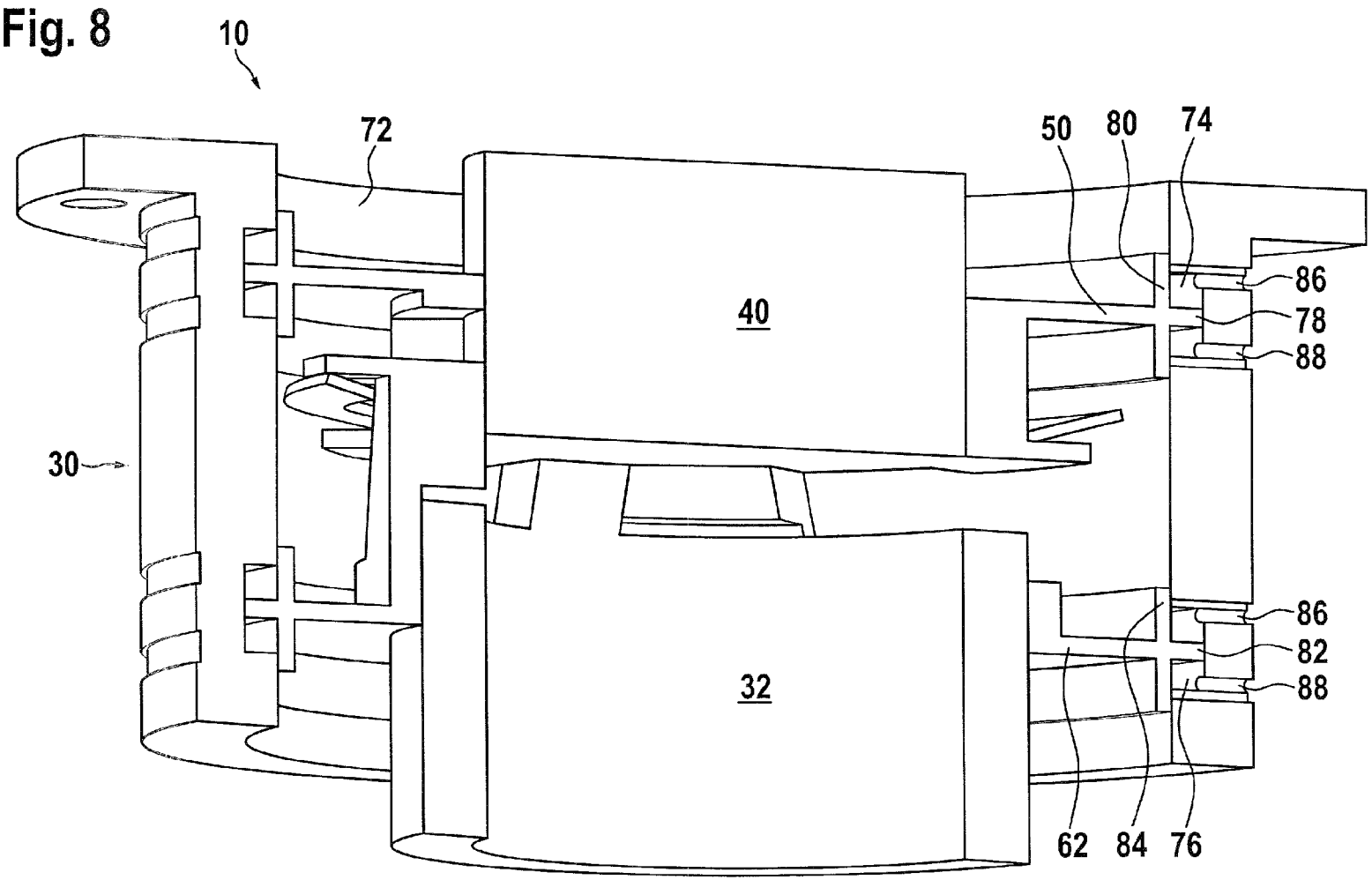
FIG. 8 illustrates the device of the present Invention inside the valve body housing with the oil channels therein.

As shown in FIG. 8, valve body 30 has sleeve 72 in which oil channels 74 and 76 are formed. In oil channel 74, distal end 78 of fin 50 is engaging. In order to seal oil channel 78, sealing ring 80 is formed at distal end 78. Distal end 82 of fin 62 with sealing ring 84 is arranged in oil channel 76.

Each oil channel 74 and 76 has two inlets 86 and 88. As can be seen, oil inlets 86 and 88 are positioned on opposite sides of distal end 78 and 82, respectively, so that they can effect axial movement of fins 50 and 62 in either direction.

Figure 9:
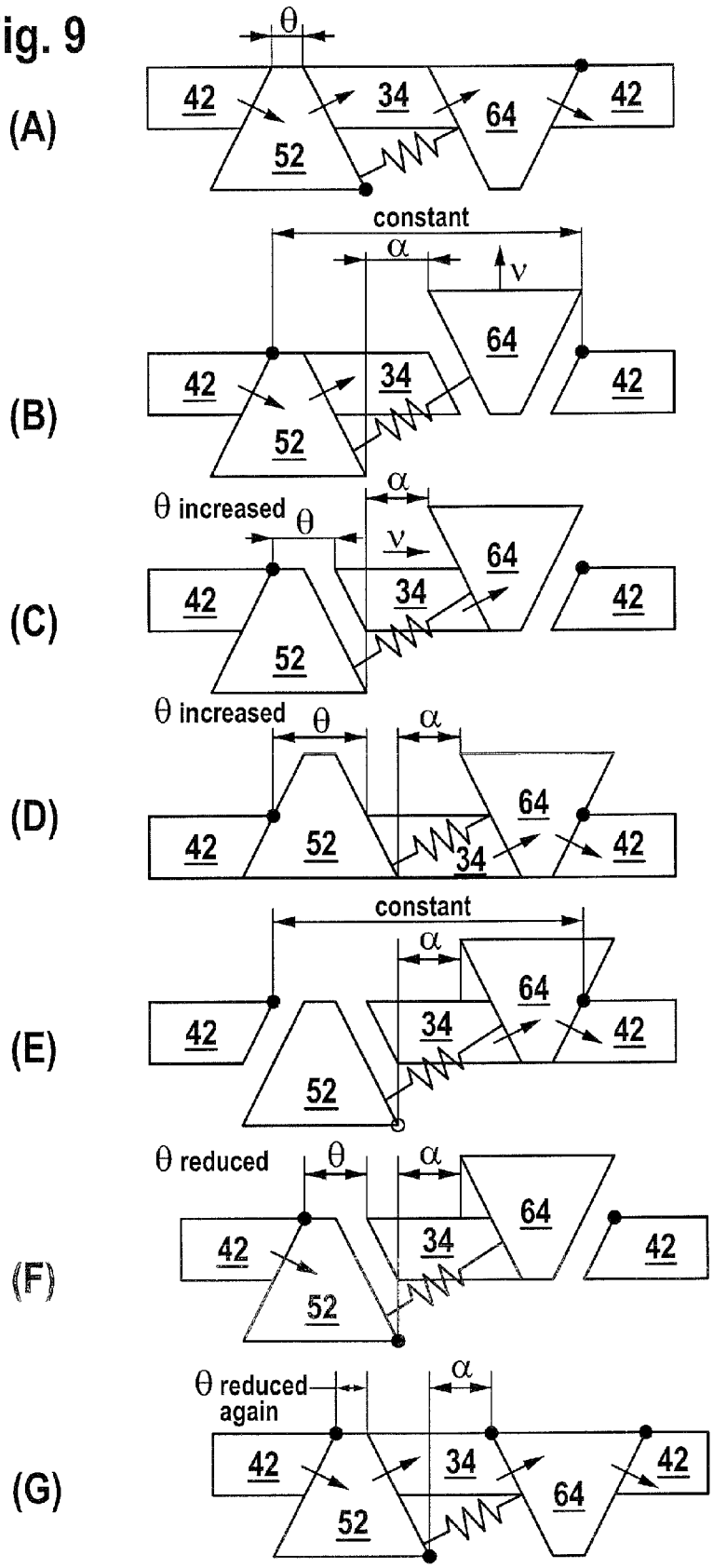
FIG. 9 illustrates the interaction of the sidewalls of the various teeth showing the phase change associated with the present Invention.

As is illustrated in FIG. 9, which shows a schematic of the interaction between the sidewalls of the teeth, it can be seen that the various angles of the sidewalls are such that they are complementary and mate with one another to form a circumferential ring.

The operation of the device will now be illustrated with respect to FIG. 9. It will be noted first, however, that sprocket 22 and camshaft connector 20 are driving and driven members alternatively. This means that driving torque flows from sprocket 22 to camshaft connector 20 overcoming friction. During valve opening, sprocket 22 is the driving element and camshaft connector 20 is the driven element. During valve closing, camshaft connector 20 is the driving element due to the force of the valve springs and sprocket 22 recovers some of the potential energy stored in the valve springs.

Turning to FIG. 9A, it shows the state of the device with no shifting. Teeth 34, 42, 52 and 64 are in contact in full circumference. The arrows shown in FIG. 9A represent contact forces. When sprocket 22 drives, the torque is transmitted through teeth 42 to teeth 52 and teeth 52 to teeth 34, but there is no force between the contacts of teeth 34 and teeth 64 and teeth 64 and teeth 42, therefore, teeth 64 can be shifted axially with a small control force through the oil channels.

If connector sliding ring 26 is subject to a shifting force through fin 62, teeth 64 will move axially outward when it is not under force from teeth 42 and 34. This creates a space in the circumference which can be taken up in the next camshaft drive event by the camshaft as shown in FIG. 9C. Meanwhile, the outward motion of teeth 64 will cause teeth 52 to move inwardly because of the force of spring washer 28, taking up the circumference space left behind by the forward motion of connector 20, see FIG. 9D. As a result of these motions, the width of teeth 64 at the contact position is decreased and the width of teeth 52 at the contact position is increased by the same amount, the relatively angular position of the crankshaft 16 and camshaft 14 is shifted by this amount.

Similarly, a shift of crankshaft 16 and camshaft 14 in the other direction can be accomplished by applying a controlling force on teeth 52 as illustrated in FIGS. 9E through 9G.

In accordance with the present Invention, a shift of 45° can he completed in five revolutions at an engine speed of 4,000 rpm.

REFERENCE CHARACTERS

10. Mechanical Variable Cam Timing Device
20. Camshaft connector
22. Crankshaft connector
24. Sprocket sliding ring
26. Connector sliding ring
28. Spring washer
30. Valve body housing
32. Connector housing
34. Connector teeth
36. Axial sidewall

38. One end of connector housing
40. Sprocket housing
42. Sprocket teeth
44. One end of sprocket housing
46. Sidewalls of sprocket teeth
48. Sprocket ring housing
50. Fin
52. Sprocket ring teeth
54. Sidewalls of sprocket ring teeth
56. Distal end
57. Proximal end
58. Shoulder
60. Connector ring housing
62. Fin
64. Connector ring teeth
66. Sidewalls of connector ring teeth
68. Distal end
69. Proximal end
70. Shoulder
72. Sleeve
74. Oil channel
76. Oil channel
78. Distal end
80. Seal ring
82. Distal end
84. Seal ring
86. Oil inlets
88. Oil inlets

I claim:

1. A device for adjusting an angular position of an internal combustion engine camshaft in relation to the engine crankshaft comprising:

(a) a camshaft connector fixed at an input end of a camshaft, the camshaft connector having a cylindrical, axial connector housing and a plurality of connector teeth extending axially and helically from one end of the connector housing;

(b) a crankshaft sprocket rotatably mounted at the input end of the camshaft and engageable with an engine crankshaft, the crankshaft sprocket having a cylindrical, axial sprocket housing and a plurality of sprocket teeth extending radially outward from one end of the sprocket housing, each of the sprocket teeth having axial, slanted sidewalls that are parallel to each other and equal and opposite a corresponding sidewall of the connector teeth, the one end of the connector housing facing the one end of the sprocket housing and the connector teeth extending over the one end of the sprocket housing;

(c) a sprocket sliding ring axially and rotatably mounted on the sprocket housing, the sprocket ring having a ring housing, a fin extending radially outward from the ring housing, a plurality of sprocket ring teeth extending trapezoidally and axially from the ring housing, and a shoulder extending radially outward from a distal end of the sprocket ring teeth, the sprocket ring teeth extending over the one end of the sprocket housing such that non-parallel axial, sidewalls of the sprocket ring teeth mating with a corresponding sidewall of the connector teeth and the sprocket teeth;

(d) a connector sliding ring axially and rotatably mounted on the connector housing, the connector ring having a ring housing, a fin extending radially outward from the ring housing, a plurality of connector ring teeth extending trapezoidally and axially from the ring housing and a shoulder extending radially outward from a distal end of the connector ring teeth, the connector ring teeth extending over the one end of the sprocket housing such that non-parallel axial sidewalls of the connector ring teeth made with a corresponding sidewall of the connecting teeth and the sprocket teeth;

(e) a spring washer is axially movable mounted over both the sprocket ring teeth and the connector ring teeth, between the connector ring shoulder and the sprocket ring shoulder and between the connector ring shoulder and a proximal end of the connector ring teeth and the sprocket ring shoulder and a proximal end of the sprocket ring teeth; and (f) a fin moving means for axially moving the sprocket ring fin and the connector ring fin to adjust the angular position of the camshaft in relation to the crankshaft.

2. The device of claim 1 wherein the fin moving, means comprises a valve body housing forming a sleeve around the sprocket ring fin and the connector ring fin, and a hydraulic system for applying hydraulic pressure for movement of the sprocket ring fin and the connector ring fin.

3. The device of claim 1 wherein the fin moving means is a solenoid.

4. The device of claim 1, wherein the connector ring teeth are isosceles trapezoidal teeth; and the sprocket ring teeth are isosceles trapezoidal teeth.

5. The device of claim 1, wherein the spring washer is a Belleville washer.

6. The device of claim 1, wherein the plurality of camshaft connector teeth are three.

7. The device of claim 1, wherein the plurality of crankshaft sprocket teeth are three.

8. The device of claim 1, wherein the plurality of sprocket ring teeth are three.

9. The device of claim 1, wherein the plurality of connector ring teeth are three.

10. The device of claim 2, wherein the value body housing has two internal radial oil channels, axially spaced from one another, one oil channel engaging a distal end of the sprocket ring fin, and the other oil channel engaging a distal end of the connector ring fin.

11. The device of claim 9, wherein an axial sealing ring, affixed at a distal end of the sprocket ring fin for sealing the one oil channel, and an axial sealing ring affixed at a distal end of the connector ring fin for sealing the other oil channel.

* * * * *